United States Patent [19]

Herron et al.

[11] 4,212,257

[45] Jul. 15, 1980

[54] SEWING MACHINE FULL AND LOW BOBBIN INDICATOR

[75] Inventors: William L. Herron, Elizabeth; Edward W. Rummel, Short Hills, both of N.J.

[73] Assignee: The Singer Company, Stamford, Conn.

[21] Appl. No.: 55,137

[22] Filed: Jul. 5, 1979

[51] Int. Cl.[2] ..... D05B 45/00

[52] U.S. Cl. ..... 112/278

[58] Field of Search ..... 112/278, 273, 279, 184; 139/273 A; 250/559, 560, 561; 242/37 R

[56] References Cited

U.S. PATENT DOCUMENTS

| | | | |
|---|---|---|---|
| 3,082,968 | 3/1963 | Reichelt et al. | 112/278 |
| 3,138,127 | 6/1964 | Ketterer | 112/184 |
| 3,599,586 | 8/1971 | Newman | 112/278 |
| 3,845,320 | 10/1974 | Winberg | 112/278 |

FOREIGN PATENT DOCUMENTS

| | | | |
|---|---|---|---|
| 326125 | 12/1957 | Switzerland | 139/273 A |

*Primary Examiner*—Peter P. Nerbun

*Attorney, Agent, or Firm*—Edward P. Schmidt; Robert E. Smith; Edward L. Bell

[57] ABSTRACT

A bobbin alarm for a sewing machine which utilizes a light source and a pair of light sensors to provide a warning of low bobbin thread remaining or of a full bobbin condition. The light sensors are arranged with respect to the light source so that one sensor lies substantially on a line from the light source tangent to the hub of the bobbin and the other sensor lies substantially on a line from the light source tangent to the periphery of an imaginary cylinder having the bobbin flanges as the ends thereof. A circuit is provided which is responsive to light stimulation of both sensors (empty bobbin condition) or no stimulation of both sensors (full bobbin condition) to provide a signal to an operator in the form of an illuminated LED.

4 Claims, 4 Drawing Figures

| TRUTH TABLE | | | |
|---|---|---|---|
| BOBBIN CONDITION | SENSORS | | LED |
| | 60 | 66 | |
| EMPTY | I | I | ON |
| IN BETWEEN | N | I | OFF |
| FULL | N | N | ON |

I-ILLUMINATED
N-NOT ILLUMINATED

SEWING MACHINE FULL AND LOW BOBBIN INDICATOR

BACKGROUND OF THE INVENTION

This invention is in the field of sewing machines, more particularly, it pertains to bobbin thread run-out indicators for sewing machines.

There are in the prior art many forms of bobbin thread run-out indicators, which indicators are invariably concerned with indicating a low bobbin thread condition or an empty bobbin condition. A low bobbin thread indicator is desirable in order to warn an operator of impending bobbin exhaustion which might interfere with the appearance of a long seam. An empty bobbin indicator would provide a warning to an operator to avert operation of the sewing machine with no thread remaining on the bobbin.

However, it frequently occurs that when the bobbin is wound, too much thread can be placed thereon, resulting in some cases in thread spillage and/or in a binding of the bobbin. There have been proposed mechanical devices designed to prevent overwinding of the bobbin. Such a device is shown in the U.S. Pat. No. 3,154,035, issued on Oct. 27, 1964 to Edwards et al. In this device a thread engaging shoe was deflected by a full thread condition of a winding bobbin into a bobbin driver causing a drag on the sewing machine during bobbin winding in order to advise an operator that the bobbin was fully wound. There is also the U.S. Pat. No. 3,138,127, issued on June 23, 1964 to Ketterer, which provided a thread engaging member which deflected the bobbin driver upon a full thread condition of the bobbin, which deflection was sensed through a microswitch arrangement detecting motion at the end of the bobbin driver shaft, thereby turning off the sewing machine. None of these prior art devices, however, provided for also sensing for a low bobbin condition with an indication to an operator thereof.

What is required is a sewing machine which will provide an indication to an operator of a low bobbin thread condition indicating the need to initiate bobbin winding; and, upon a full bobbin condition, provide an indication to an operator thereof.

SUMMARY OF THE INVENTION

The above requirement is met in applicant's invention in which a light source is provided on one side of the sewing machine looptaker with a lens focusing light rays above the looptaker and through openings in the bobbin case carried therein. The lens directs light rays adjaent the hub of the bobbin carried by the bobbin case, and if not occluded by thread carried on the hub of the bobbin, the light rays pass to a first light sensor supported by the sewing machine frame on the opposite side of the looptaker from the light source. The lens also directs light rays tangent or nearly tangent to the periphery of the bobbin to a second light sensor also supported by the sewing machine frame adjacent the looptaker. Circuit detection means are provided which are sensitive to excitation of sensor 1 or deexcitation of sensor 2 so as to turn on the LED mounted on the front of the sewing machine adjacent the needle bar to advise an operator of a low bobbin condition or of a full bobbin condition, respectively.

DESCRIPTION OF THE DRAWINGS

For a better understanding of the invention, reference may be had to the specification and the drawings in which.

DESCRIPTION OF THE PREFERRED EMBODIMENT

Figure 1:
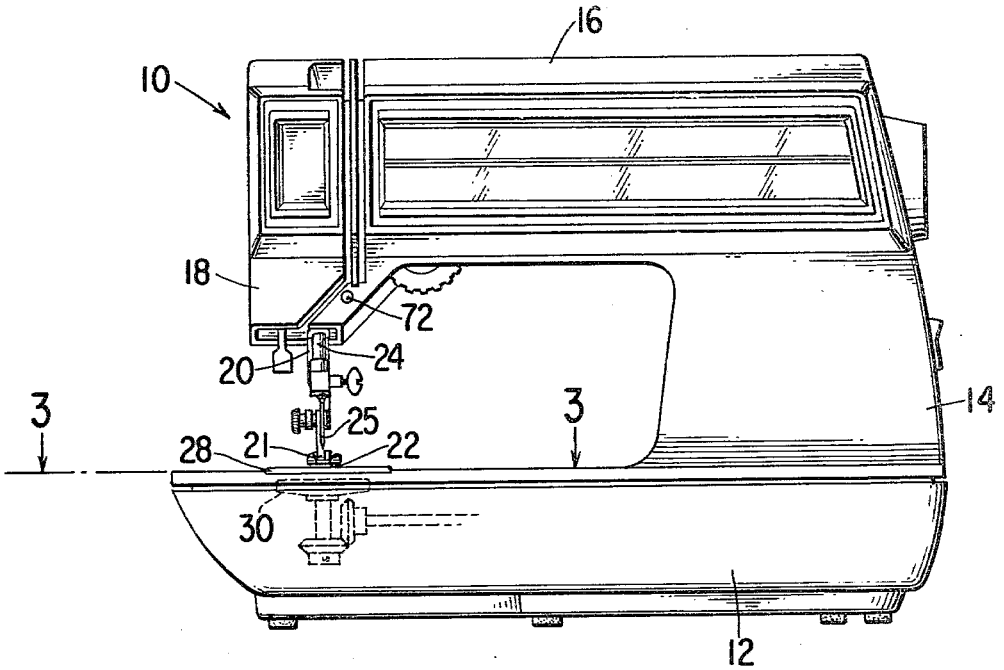
FIG. 1 is a front elevational view of a sewing machine in the which the invention may be incorporated.

Referring now to the drawings there is shown in FIG. 1 a sewing machine 10 to which the invention may be applied. The frame portion of the sewing machine 10 includes a bed 12, from one end of which rises a standard 14. The standard 14 supports an arm 16 in overhanging relationship to the bed 12, the arm terminating in a head portion 18. Within the head portion 18 there is supported in the usual fashion for sewing machines, a presser bar 20 terminating in a presser foot 21 for urging work material against feed dog 22 in the bed 12 of the sewing machine 10. Also supported in head portion 18 for endwise reciprocation as is well known in the sewing machine art is a needle bar 24 terminating in a sewing needle 25, supported in such a fashion that the sewing needle will cooperate with a rotating looptaker 30 (see also FIG. 3) supported in the bed 12. Not shown in FIG. 1 is the feed system for the feed dogs 22 which is supported in the bed 12 and which, intermittent to penetration of the work material by the sewing needle 25, urges the work material in a selected direction forward or reverse. Also not shown is the actuating means for causing endwise reciprocation of the needle bar 24, and for causing rotation of the looptaker as well as for driving the feeding system. There is apparent in FIG. 1 the bed slide 28 which normally covers the rotating looptaker 30 while providing support for the work material.

Figure 2:
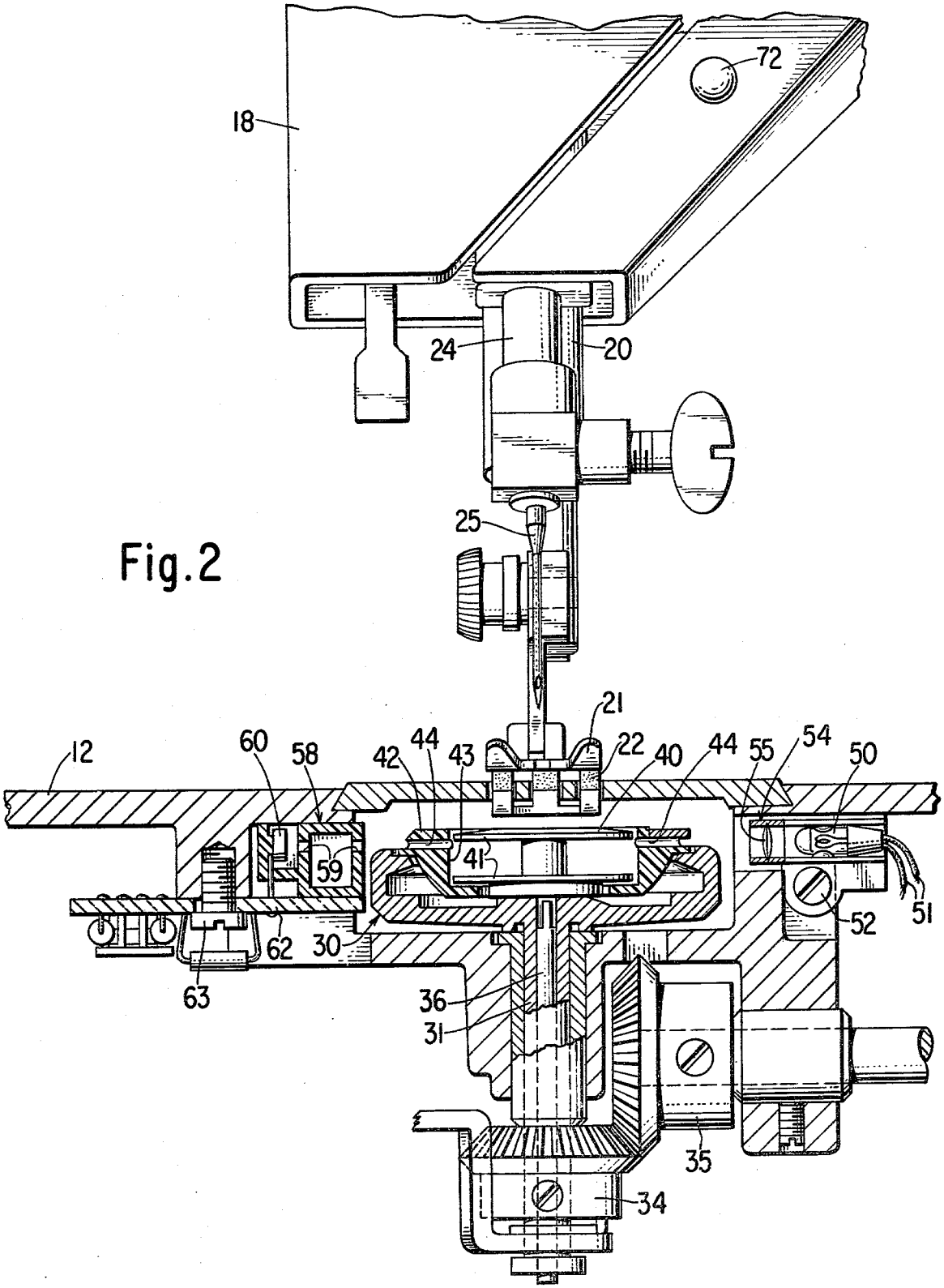
FIG. 2 is an enlarged front elevational view of a portion of a sewing machine shown in FIG. 1 partially in section to show the details of the construction thereof.

Referring now to FIG. 2 there is shown an elevational view of a portion of the sewing machine in the area of the sewing needle 25. A portion of the bed 12 has been cut away in order that the looptaker 30 and other components supported in the bed may be more clearly shown. Thus, it is clear that the rotating looptaker 30 is supported for rotation in a bushing 32 carried in the bed 12 of the sewing machine. The rotating looptaker 30 is formed with a shaft 31 at the end of which is fixed a gear 34, which gear is in mesh with a gear 35 driven, ultimately, in the usual fashion, by the sewing machine drive motor (not shown). The looptaker shaft 31 carries internally thereof a spindle 36 having a slabbed extremity 37, which slabbed extremity may be urged by other instrumentalities (not shown) into engagement with a cavity in the bottom of the bobbin 40 in order to positively drive the bobbin during a thread winding operation thereupon. For further particulars on the bobbin thread replenishing mechanism herein used, the reader is referred to the U.S. Pat. No. 3,693,566, issued on Sept. 26, 1972 to Ketterer, and assigned to the same assignee as the instant application, which is hereby incorporated by reference herein. In that patent there is disclosed a lockstitch stitch sewing mechanism as here depicted in which needle thread may be directed to the bobbin for bobbin thread replenishment along a path beneath the level of the path of the loop seizing beak of the looptaker, together with means for introducing and snubbing the thread on a plain cylindrical bobbin hub of small diameter whereby an appreciable increase in bobbin thread capacity is obtained.

Supported internally of the rotating looptaker 30 is a bobbin case 42, which bobbin case is, as is well known in the sewing machine art, held stationary against rotation with the looptaker. A bobbin 40 is supported internally of the bobbin case 42 in a cavity provided therefore. In normal operation the bobbin 40 is freely rotatable in the bobbin case 42 so that lower thread may be removed therefrom during the formation of stitches. As referred to above, during bobbin winding, the bobbin 40 rotates under the urgings of the spindle 36 within the cavity 43 in the bobbin case 42. As seen in FIG. 2, the bobbin case 42 is further formed with holes or openings 44 which extend through the bobbin case above the level of the looptaker 30 and are arranged in an axial path to provide a line of sight through the bobbin case 42 and between the flanges 41 of the bobbin 40.

Supported adjacent the rotating looptaker 30 is a light source 50 affixed to the bed 12 of the sewing machine by screw 52. The light source 50 is formed by a low wattage bulb which is connected by leads 51 to a source of power whenever the sewing machine 10 is operated, for example. Situated in front of the light source 50 and connected thereto is a lens assembly 54 having a lens 55, which is visible in FIG. 2. The lens 55 visible in FIG. 2 is arranged to direct a ray of light down the axially aligned openings 44 in the bobbin case 42 in order to increase the amount of light passing through the openings. On the opposite end of the rotating looptaker 30 from the light source 50 there is situated a mask box 58 whose purpose is to shield from extraneous light a light sensor 60 mounted internally thereof. The mask box 58 is fashioned with two orifices 59 in walls thereof which are together in alignment with the light sensor 60 and the axially aligned paths provided by the openings 44 through the bobbin case 42 to the lens 55 on the opposite of the looptaker 30. The mask box 58 is fastened on a printed circuit board 62 to which light sensors 60 are connected. The printed circuit board 62 is affixed to the bed 12 by screw 63.

Figure 3:
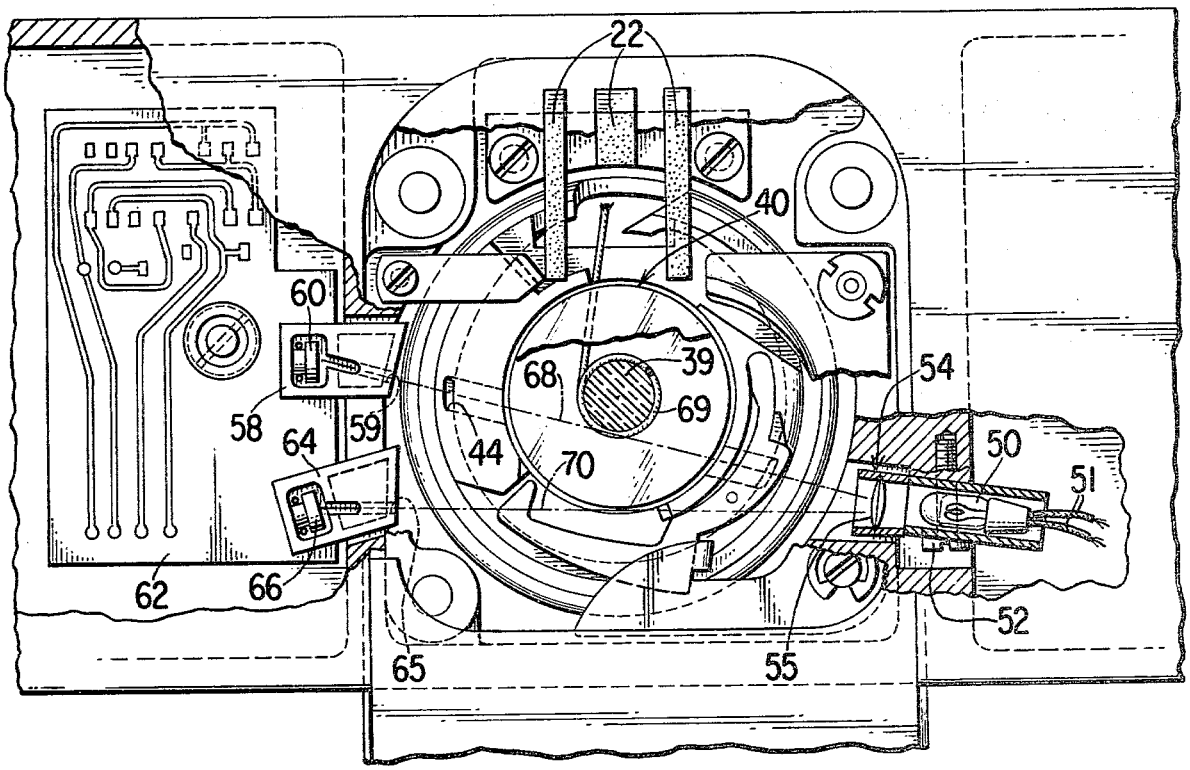
FIG. 3 is a view taken substantially along line 3—3 of FIG. 1 showing a view in plan of a portion of the bed, partially broken away, in which certain components thereof have been removed in order to show detail; and, FIG. 4 is a circuit diagram of the logic for actuating the operator indication LED, when the bobbin is either low or full.

Referring now to FIG. 3, the throat plate area of the sewing machine is shown in plan so as to clearly show the arrangement of the mask box 58 and a second mask box 64, each supported on printed circuit board 62 adjacent each other, and the axial paths 68, 70 from the mask boxes to the lens 55 of the lens assembly 54 attached to the light source 50. The axial path 68 extends from the lens 55 to the mask box 58, along a path adjacent the hub 39 of the bobbin 40 so as to permit a light ray to extend from the lens to the light sensor 60 when, for example, a single thread 69 remains upon the hub. The axial path 70 extends from the lens 55 of lens assembly 54 adjacent the periphery of the bobbin 40 and through the orifices 65 of the mask box 64 to the light sensor 66 supported therein. Thus, a thread build-up on the hub 39 of the bobbin 40 to the extremes of the flanges 41 of the bobbin will block a ray of light extending from the lens 55 of the lens assembly 54 to the light sensor 66, providing an indication that the bobbin is full. The indication to be provided may be in the form of a noise or a light, arranged in a location clearly visible to a sewing machine operator such as in the head portion 18 of the sewing machine 10. Such an indication may be effected by an LED 72 located as is shown in FIGS. 1 & 2.

Figure 4:
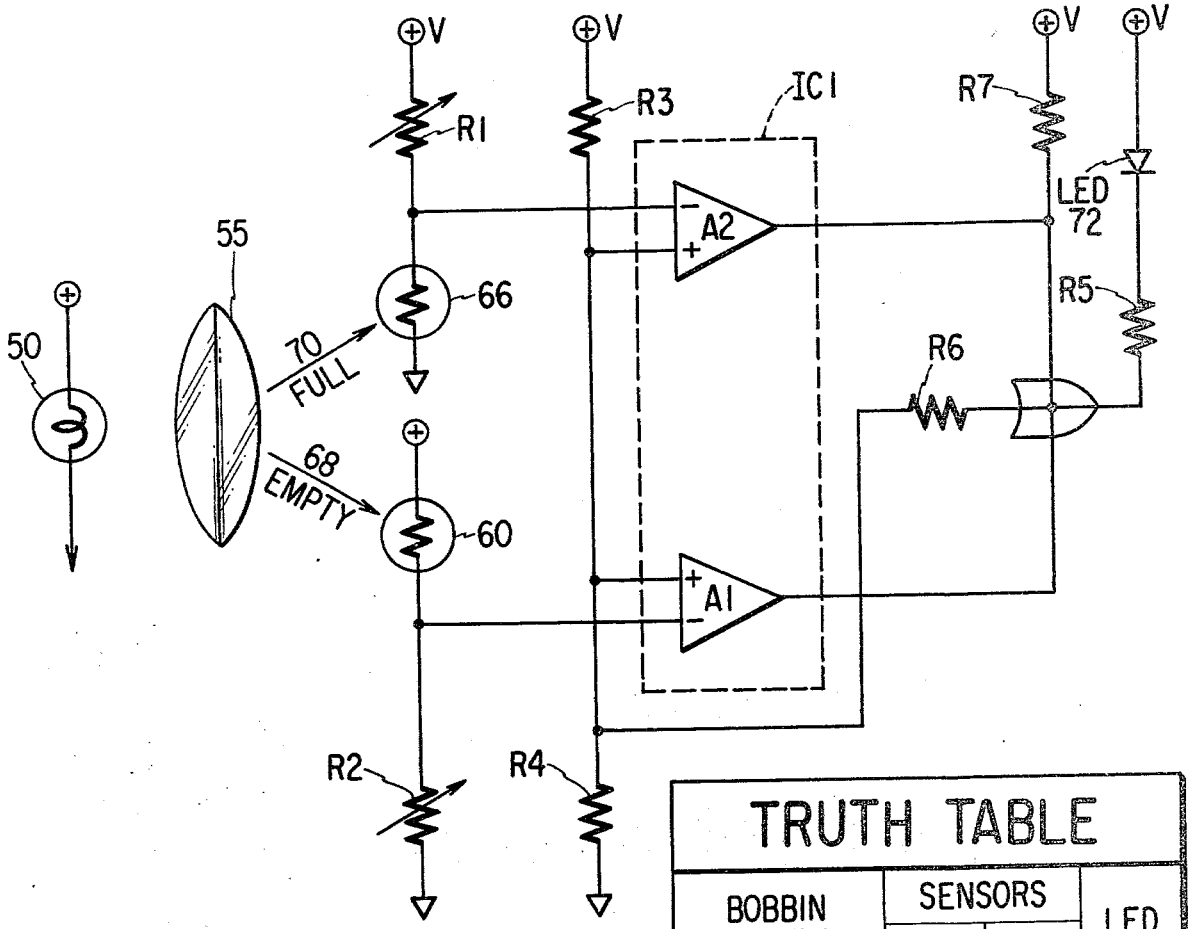

Referring now to FIG. 4 there is shown a circuit which may be used with the light sensors 60, 66 in order to actuate the LED 72 to indicate the status of the bobbin 40. Thus, light from the source 50 is directed to the bobbin 40 by lens 55. An empty bobbin 40 permits passage of light along path 68 from the lens 55 to light sensor 60. A full bobbin blocks passage of light along path 70 from lens 55 to light sensor 66. Sensors 60 and 66 are photoconductive cells whose resistance is a function of received light. Integrated circuit IC1 is a commercially available dual comparator, LM393. If the sensors 60 and 66 are both illuminated, i.e., an empty bobbin, A1 causes LED 72 to be on through R5. If sensors 60 and 66 are both dark, i.e., a full bobbin, A2 causes LED 72 to be on through R5. If sensor 66 is illuminated and not sensor 60, the LED 72 is held off by A1 and A2. The hysteresis provided by R3, R4, R6 and R7 assures a snap like action for turning the LED 72 on and off. R5 and +V determines LED 72 brightness. R1 and R2 determine light sensitivity. R3 and R4 set the comparator threshold level shared by A1 and A2. A Truth Table discloses that for an empty bobbin condition both sensors 60 and 66 are illuminated, and LED 72 will be on. For a condition between empty and full, the sensor 60 will not be illuminated, since thread remains on the hub 39 of the bobbin 40; and although sensor 66 is illuminated, the LED 72 will be off. For a full bobbin condition the sensor 60 and 66 are both not illuminated the LED 72 will be on.

Thus, has been described a bobbin indicator arrangement for a sewing machine which will indicate to a sewing machine operator an empty bobbin condition during stitching, or will advise an operator of a full bobbin during a bobbin winding condition.

We claim:

1. A lockstitch sewing machine comprising a frame, said frame supporting sewing instrumentalities including a needle carrying needle bar supported by said frame for endwise reciprocation, a feed system for urging work material in a path under said needle, a looptaker supported in said frame for cooperation with said needle in the formation of stitches, a bobbin case supported by said looptaker, said bobbin case supporting therein a bobbin having a pair of flanges separated by a thread carrying hub, said bobbin case and said bobbin extending from said looptaker a sufficient distance to have a flange and a portion of said hub of said bobbin extending therefrom, a light source situated adjacent said looptaker and extending light rays above said looptaker and through apertures in said extending portion of said bobbin case provided therefore, a first and a second light sensor on the opposite side of said looptaker from said light source, said first light sensor being aligned in a path extending between said light source and said first sensor adjacent said hub of said bobbin, the second light sensor being arranged in a path extending between said light source and said second sensor substantially tangent to the periphery of an imaginary cylinder having the bobbin flanges as extremes thereof, and means for providing an indication of a completed light path between said light source and said first light sensor and an indication of an interrupted light path between said light source and said second light sensor.

2. A lockstitch sewing machine as claimed in claim 1 wherein said sewing machine further comprises a lens assembly cooperating with said light source, said lens assembly having means thereon for augmenting light transmission to said first and said second light sensors.

3. A lockstitch sewing machine as claimed in claim 2 wherein said providing means is responsive to a completed light path between both said first and second light sensors and to an interrupt light path between both said first and said second light sensors to provide an indication.

4. A lockstitch sewing machine as claimed in claim 3 wherein said indication is implemented by a LED supported on said frame of said sewing machine.

* * * * *